US008528652B2

(12) United States Patent
Al Thawad

(10) Patent No.: US 8,528,652 B2
(45) Date of Patent: Sep. 10, 2013

(54) FIRE EXTINGUISHING BALL

(75) Inventor: Wafa Rashed Zaid Al Thawad, Riyadh (SA)

(73) Assignee: King Saud University, Riyadh (SA)

( * ) Notice: Subject to any disclaimer, the term of this patent is extended or adjusted under 35 U.S.C. 154(b) by 213 days.

(21) Appl. No.: 13/275,140

(22) Filed: Oct. 17, 2011

(65) Prior Publication Data

US 2013/0092402 A1 Apr. 18, 2013

(51) Int. Cl.
*A62C 8/00* (2006.01)

(52) U.S. Cl.
USPC ..... 169/36; 169/9; 169/11; 169/19; 169/26; 169/35; 169/56; 169/57

(58) Field of Classification Search
USPC ..... 169/9, 11, 19, 26, 35, 36, 54, 56, 169/57, 60
See application file for complete search history.

(56) References Cited

U.S. PATENT DOCUMENTS

| | | | | |
|---|---|---|---|---|
| 117,891 | A | 8/1871 | Johnson | |
| 1,565,036 | A * | 12/1925 | Tank | 169/36 |
| 4,113,020 | A | 9/1978 | Panetta | |
| 4,197,915 | A | 4/1980 | Martin | |
| 5,040,610 | A | 8/1991 | Blanchong | |
| 5,232,053 | A | 8/1993 | Gillis et al. | |
| 5,590,717 | A * | 1/1997 | McBay et al. | 169/26 |
| 6,056,063 | A | 5/2000 | Hung | |
| 6,796,382 | B2 | 9/2004 | Kaimart | |
| 7,083,000 | B2 * | 8/2006 | Edwards et al. | 169/36 |
| 7,090,029 | B2 * | 8/2006 | Cleary et al. | 169/36 |
| 7,147,061 | B2 | 12/2006 | Tsutaoka et al. | |
| 7,261,165 | B1 | 8/2007 | Black | |

FOREIGN PATENT DOCUMENTS

JP 6-190077 A 7/1994

OTHER PUBLICATIONS

Fire Extinguisher Ball, Alibaba website, http://www.alibaba.com/product-tp/118498775/Fire_Extinguisher_Ball.html.

* cited by examiner

*Primary Examiner* — Steven J Ganey
(74) *Attorney, Agent, or Firm* — Richard C. Litman

(57) ABSTRACT

The fire extinguishing ball includes an outer ball cage, an inner ball cage freely rotatable within the outer ball cage about one axis, and an internal fire extinguishing assembly carried by the inner ball cage and freely rotatable therein about a different axis. The internal fire extinguishing assembly includes a hollow ball-shaped body containing compressed gas and fire extinguishing agents. A valve assembly attached to the top of the body permits refilling of the body and dispersion of the contents during operation. The internal fire extinguishing assembly is connected to the inner ball cage so that the valve assembly will be disposed on top when the fire extinguishing ball is at rest. The ball can be tossed or rolled towards fires in difficult to reach areas. Exposure to heat opens the valve in the valve assembly to thereby disperse the contents of the body and extinguish the flames.

7 Claims, 5 Drawing Sheets

FIRE EXTINGUISHING BALL

BACKGROUND OF THE INVENTION

1. Field of the Invention

The present invention relates to fire safety devices, and particularly to a fire extinguishing ball that can be safely deployed into difficult to reach areas.

2. Description of the Related Art

When one is faced with a fire emergency, one of the most difficult and dangerous aspects of combating the fire is being able to approach close enough to effectively extinguish the flames with whatever means are available. In most situations, it may be relatively safe to hose down a burning building or domicile with water or fire extinguishing chemicals from a distance. However, firefighters oftentimes must charge into the burning building in their attempts to rescue survivors. In this scenario, firefighters face many hazards, such as smoke, backdrafts and potential falling debris. Even if a survivor is reached, rescue may not be possible due to surrounding fire. The surrounding fire may be located in a place where the conventional fire hose cannot reach or so vigorous that a conventional fire extinguisher will be ill suited to handle the flames.

Similar issues can also occur in industrial sites. While most large-scale industrial fires can be relatively easy to reach, other small-scale or localized fires can occur in areas where it is difficult or even impossible to reach by conventional means, e.g., ducts for air and wires.

Many fire-fighting devices have been proposed which will help combat the fires in the above examples to a degree. Some examples include the conventional fire extinguisher mentioned above and explosive devices that contain fire-extinguishing agents. With respect to the fire extinguisher, this device is typically heavy and cumbersome requiring much physical effort to carry and operate. Moreover, they require expert periodic inspection and maintenance. With respect to the explosive devices, they can be costly and difficult to manufacture due to the materials and processes used to make them safe for normal use, e.g., the shell is usually made from materials that will not turn into shrapnel upon explosion. Oftentimes, special care must be exercised when using such devices.

In light of the above, it would be a benefit in the fire fighting arts to provide a fire-extinguishing device that can be easily and safely deployed in typically inaccessible areas. Thus, a fire extinguishing ball solving the aforementioned problems is desired.

SUMMARY OF THE INVENTION

The fire extinguishing ball includes an outer ball cage, an inner ball cage freely rotatable within the outer ball cage about one axis, and an internal fire extinguishing assembly carried by the inner ball cage and freely rotatable therein about a different axis. The internal fire extinguishing assembly includes a hollow ball-shaped body containing compressed gas and fire extinguishing agents. A valve assembly attached to the top of the body permits refilling of the body and dispersion of the contents during operation. The internal fire extinguishing assembly is connected to the inner ball cage so that the valve assembly will be disposed on top when the fire extinguishing ball is at rest. The ball can be tossed or rolled towards fires in difficult to reach areas. Exposure to heat opens the valve in the valve assembly to thereby disperse the contents of the body and extinguish the flames.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
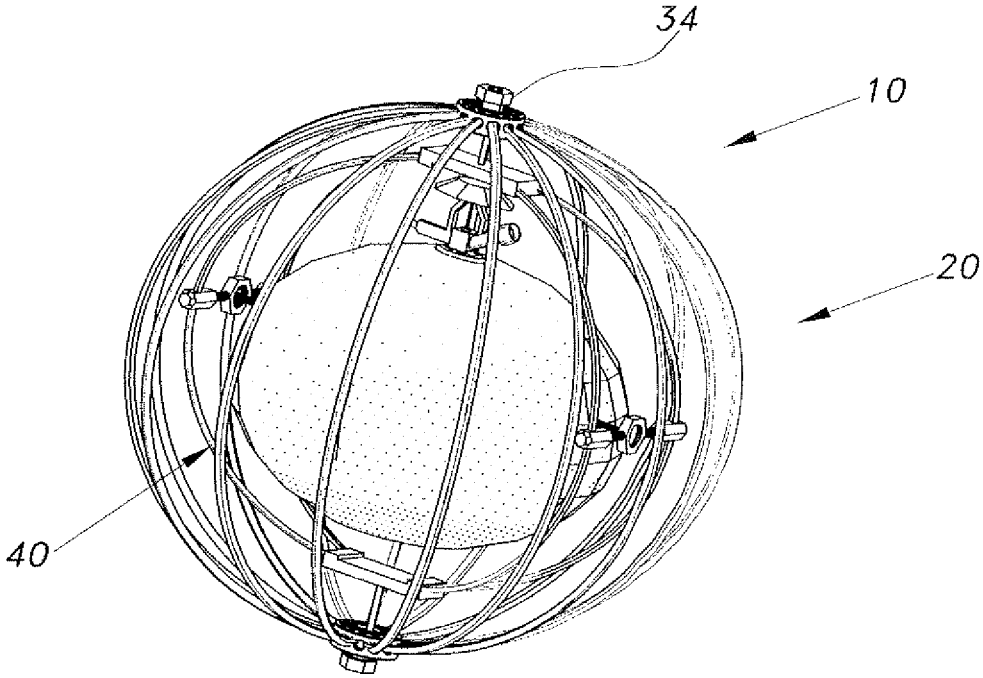
FIG. 1 is a perspective view of a fire extinguishing ball according to the present invention.

The fire extinguishing ball, generally referred to in the drawings by reference number 10, provides a safe means of extinguishing fires in typically inaccessible or hard to reach areas. The user rolls or tosses the fire extinguishing ball 10 into the target area from a safe distance, and the heat of the flames opens up a valve assembly to thereby release fire extinguishing agents on and around the fire extinguishing ball 10.

As shown in FIGS. 1-4, the fire extinguishing ball 10 includes an outer ball cage or frame 20, an inner ball cage or frame 40 rotatable within the outer ball cage 20, and an internal fire extinguishing assembly 60 carried by the inner ball cage 40 and rotatable therein. The outer ball cage 20 includes two spaced ring connectors 22 and a plurality of arcuate or curved wires, bars or beams 21 connected to the ring connectors 22 at their respective ends. The curved wires 21 are angularly spaced around the ring connectors 22 to form a ball or spherical shape. The wires 21 can be constructed from metal, composites or other materials that can withstand heat from a typical fire without losing its shape, at least long enough for the internal fire extinguishing assembly 60 to perform.

Figure 2:
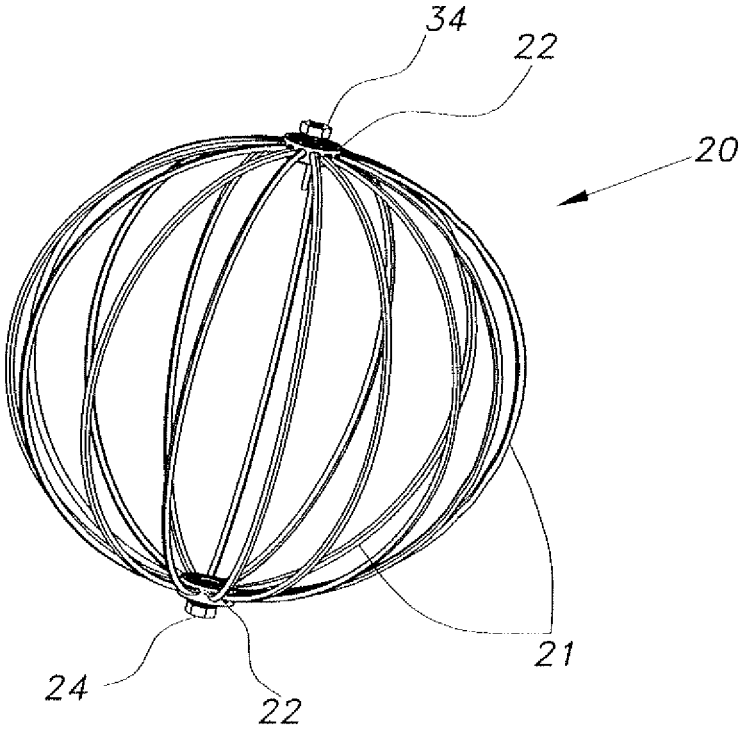
FIG. 2 is a perspective view of the outer ball cage of the fire extinguishing ball shown in FIG. 1.
Figure 7:
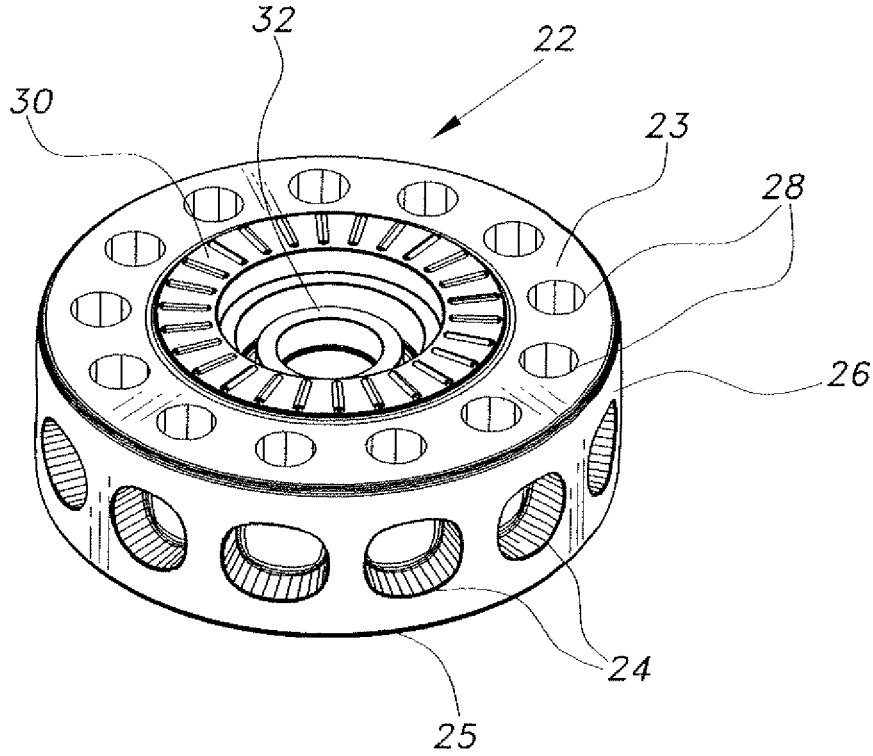
FIG. 7 is a perspective view of a ring connector for the outer ball cage of FIG. 2.
Figure 8:
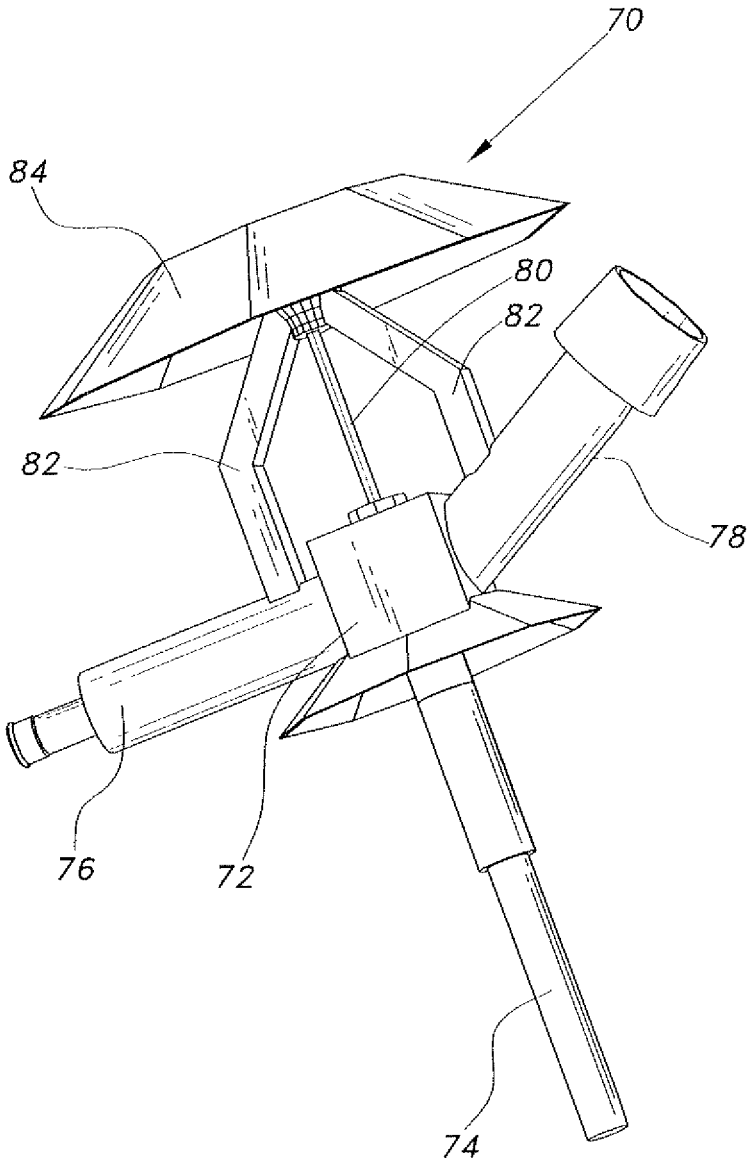
FIG. 8 is a perspective view of the valve assembly for the internal fire extinguishing assembly of FIG. 4.

As shown in FIGS. 1, 2 and 7, each ring connector 22 can be a cylindrical disk having a top side 23, a bottom side 25 and an outer, circumferential side surface 26. A plurality of mounting holes or bores 24 are formed around the circumferential side surface 26 at spaced intervals, the mounting holes 24 being constructed to receive one of the ends of the curved wires 21. A plurality of set holes or bores 28 are formed and circumferentially spaced on the top side 23, each set hole 28 being in communication with a corresponding mounting hole 24. The end of a curved wire 21 is inserted into one of the mounting holes 24, and that end can be secured by a set screw through the corresponding set hole 28. Although a circular, disk-shaped ring connector 22 has been disclosed, the ring connector 22 can be constructed in a variety of shapes that include mounting holes 24 and set holes 28. The ring connector 22 also includes an inner bearing 30. The inner bearing 30 facilitates rotation of the inner ball cage 40 when the inner ball cage 40 is mounted inside the outer ball cage 20.

Figure 3:
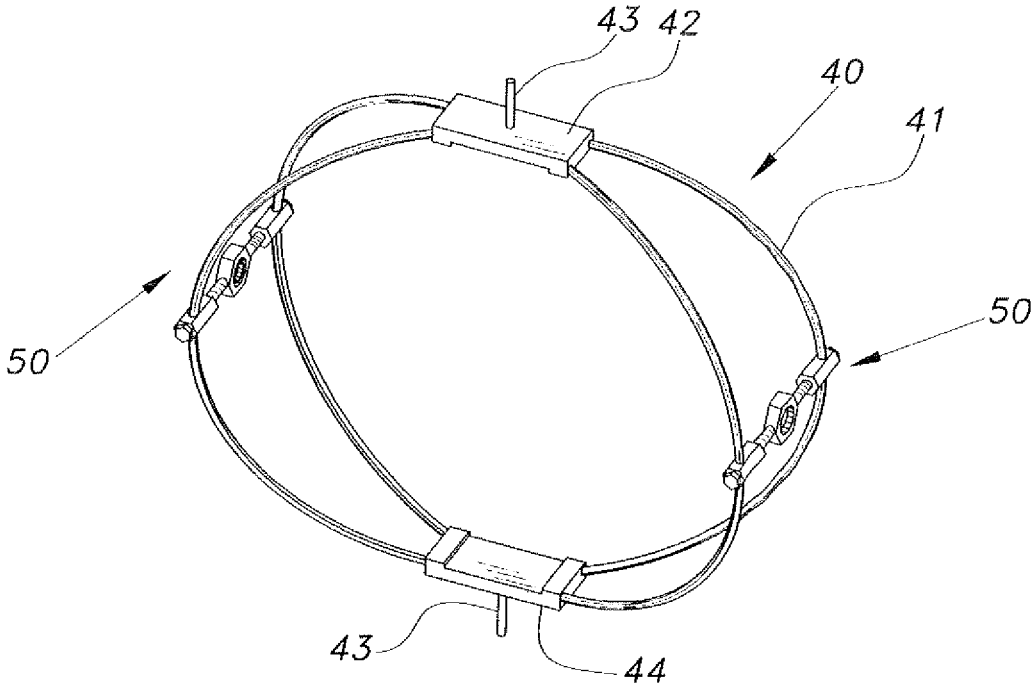
FIG. 3 is a perspective view of the inner ball cage of the fire extinguishing ball shown in FIG. 1.

As shown in FIGS. 1 and 3, the inner ball cage 40 includes an upper mounting bracket 42 and a lower mounting bracket 44. A plurality of arcuate or curved wires, bars or beams 46 are connected to and extend between the upper and lower mounting brackets 42, 44 to give structure and shape to the inner ball cage 40. The curved wires 46 are preferably constructed from the same materials as the curved wires 21. A swivel joint assembly 50 is disposed on opposite sides of the inner ball cage 40. Each swivel joint assembly 50 is slidably mounted to a pair of the curved wires 46. The swivel joint assembly 50 facilitates free rotation of the internal fire extinguishing assembly 60. Each mounting bracket 42, 44 also includes a mounting rod or bar extending outwardly therefrom for rotatably attaching the inner ball cage 40 to the outer ball cage 20. Each mounting rod 43 passes through a through bore 32 in the respective inner bearing 30 on the ring connectors 22, and the mounting rod 43 is secured thereon by a fastener or nut 34. With this construction, the inner ball cage 40 is free to rotate inside and independently of the outer ball cage 20 about the axis defined by the mounting rods 43.

Figure 6:
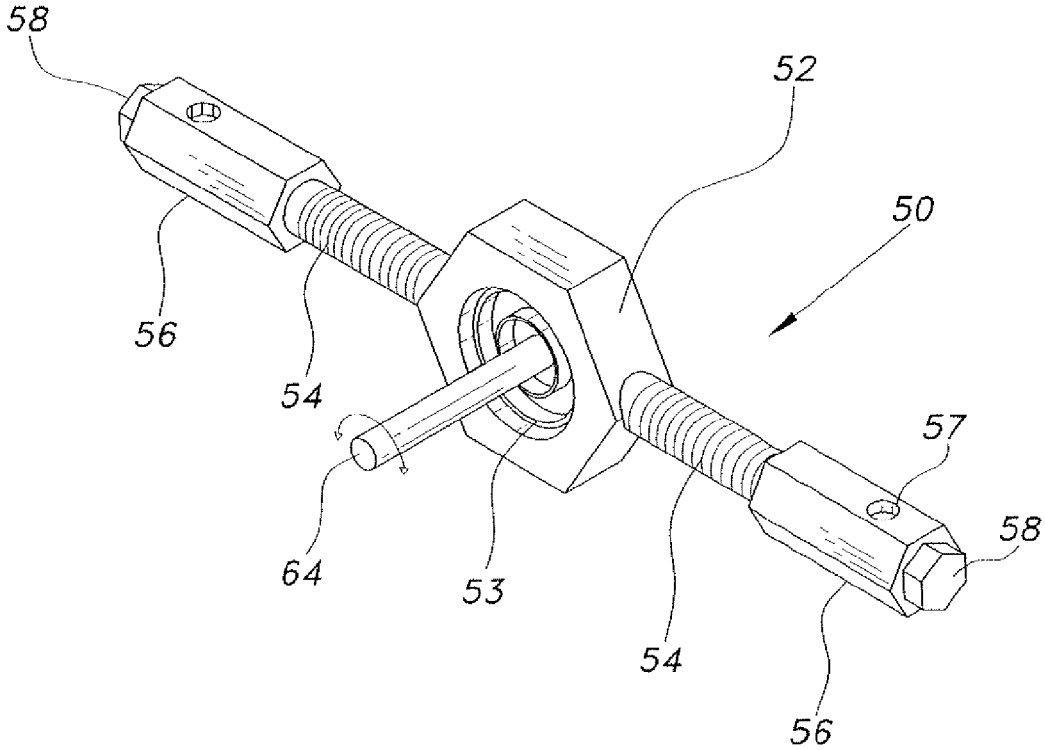
FIG. 6 is a perspective view of a joint for connecting the internal fire extinguishing assembly of FIG. 4 to the inner ball cage of FIG. 3.

As shown in FIGS. 1, 3 and 6, the swivel joint assembly 50 includes a central swivel joint 52 having a bearing 53 therein. The bearing 53 rotatably connects the internal fire extinguishing assembly 60 to the inner ball cage 40 so that the internal fire extinguishing assembly 60 can freely rotate inside and independently of the inner ball cage 40. An extension bar, beam or rod 54 extends from opposite sides of the central swivel joint 52. Each extension rod 54 is threaded to facilitate adjustable connection of a mounting head 56, as well as attachment to the central swivel joint 52. Each mounting head 56 includes a through bore 57 for slidably mounting that end of the swivel joint assembly 50 to one of the curved wires 46. Slight adjustments of the mounting head 56 along the extension rod 54 can be made to properly position the central swivel joint 52 for mounting the internal fire extinguishing assembly 60. The adjustable movement can be limited by the end cap 58.

Figure 4:
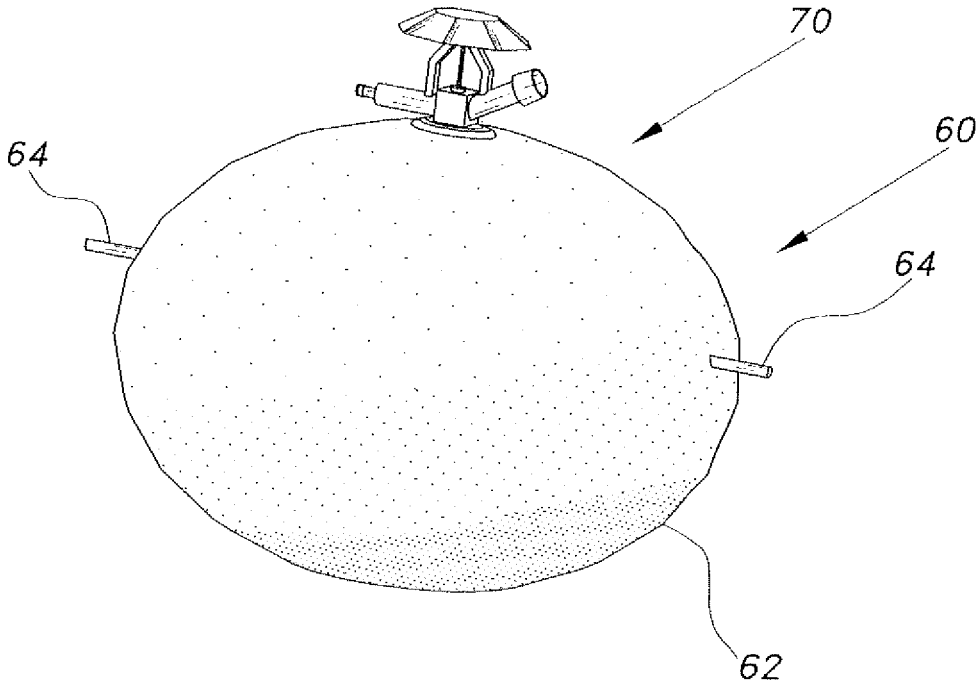
FIG. 4 is a perspective view of the internal fire extinguishing assembly of the fire extinguishing ball shown in FIG. 1.
Figure 5:
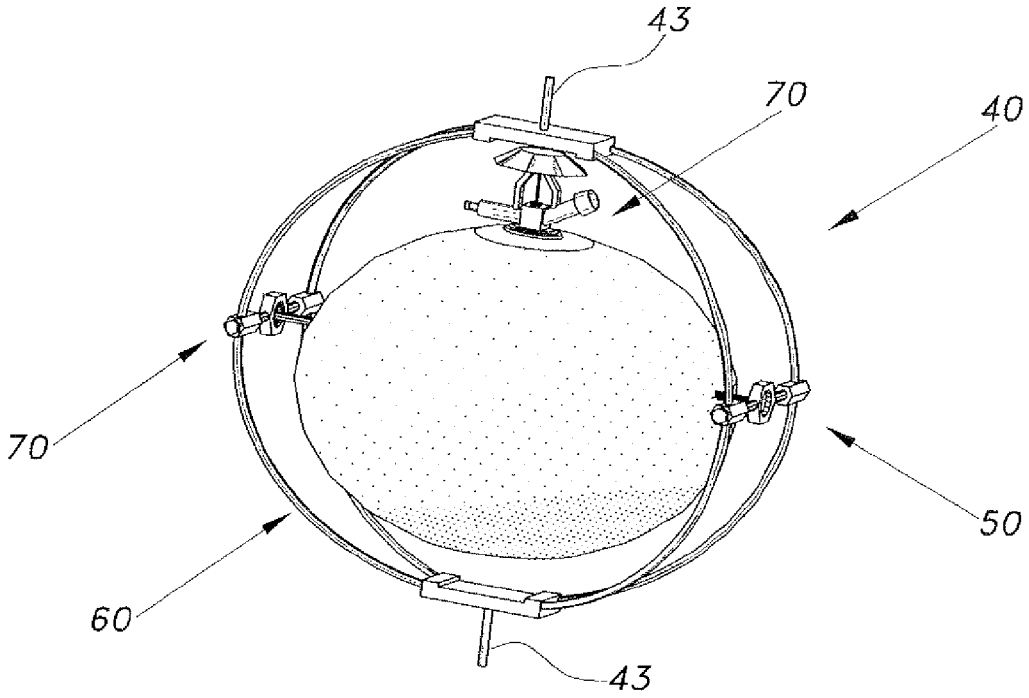
FIG. 5 is a perspective view of the internal fire extinguishing assembly of FIG. 4 shown mounted to the inner ball cage of FIG. 3.

As shown in FIGS. 1, 4 and 5, the internal fire extinguishing assembly 60 includes a ball-shaped body 62 and a connection rod, bar or beam 64 extending outwardly from opposite ends of the body 62. The body 62 can be spherical, ovoid or any other ball shape. Each connection rod 64 is configured to be insertably mounted to a respective one of the central swivel joints 52 in a manner that allows free rotational movement of the internal fire extinguishing assembly 60 within the inner ball cage 40 about an axis defined by the connection rods 64, this axis being different from the rotational axis of the inner ball cage 40. The body 62 is hollow and constructed from copper or fiberglass, materials that are light and resist high temperature and pressure. The body 62 is filled with compressed gas and fire extinguishing agents. The top of the body 62 includes a valve assembly 70 where the body 62 can be filled with the compressed gas and fire extinguishing agents. Moreover, the valve assembly 70 facilitates dispersion of the fire extinguishing agents during operation. For effective operation of the fire extinguishing ball 10, the connection rods 64 are preferably placed at points offset from the central axis of the body 62, i.e., between the central axis and the valve assembly 70. With this construction, the weight or center of mass of the internal fire extinguishing assembly 60 will be concentrated toward the ground as the assembly 60 swivels on the swivel joint assembly 50. This allows the internal fire extinguishing assembly 60 to right itself with the valve assembly 70 at the top whenever the fire extinguishing ball 10 is at rest.

As shown in FIGS. 1, 4, 5 and 8, the valve assembly 70 includes a valve housing 72 connected to first and second adjacent ports 76, 78 extending from the valve housing 72. The first port 76 can be configured to introduce the compressed air into the body 62 while the second port 78 can be configured to introduce the fire extinguishing agents. A flow tube 74 is connected to the valve housing and extends towards the bottom of the interior of the hollow body 62. The flow tube 74 allows the gas and agents to flow into the interior, and to exit therefrom. The valve housing 72 includes a thermally sensitive valve, such as a mercury valve, as is known in the art. When exposed to heat, the mercury expands rapidly and opens the valve 70. Upon opening, the contents of the body 62 escape through the flow tube 74 and funnel through a dispersion tube 80. The dispersion tube 80 is preferably smaller in diameter than the flow tube 74 in order to increase escape pressure. The dispersion tube 80 is supported by a support bracket 82. In order to maximize the area that can be reached by the escaping fire extinguishing agents, the valve assembly 70 includes a dispersion shroud 84. The shroud 84 may be shaped as an umbrella. As the contents escape from dispersion tube 80, the contents deflect off the interior surface of the shroud 84 to spread the fire extinguishing agents in a wide 360° area. The shroud 84 is also supported by the support bracket 82.

In operation, the user tosses or rolls the fire extinguishing ball 10 towards the desired area in flames. Once in the fire, the independent rotational movements of the outer ball cage 20, the inner ball cage 40 and the internal fire extinguishing assembly 60 allows the fire extinguishing assembly 60 to right itself with the valve assembly 70 disposed on top, this action being aided by the offset rotational axis of the internal fire extinguishing assembly 60 with respect to the inner ball cage 40. As the body 62 heats from exposure to the flames or heat source, this causes the valve in the valve housing 72 to rapidly open and allow the compressed gas and fire extinguishing agents inside to escape. The shroud 84 helps to disperse the contents in a wide circular area to extinguish the fire.

Thus, it can be seen that the fire extinguishing ball 10 can be an economical, lightweight solution for extinguishing fires in typically inaccessible or hard to reach places. The ball cage construction minimizes the weight of the fire extinguishing ball 10 while providing high mobility for placing the same in the desired area.

It is to be understood that the fire extinguishing ball. 10 encompasses a variety of alternatives. For example, the fire extinguishing ball 10 can be constructed in a variety of sizes, depending on the needs of the user. Moreover, the body 62 can contain specific fire extinguishing agents for specific types of fires.

It is to be understood that the present invention is not limited to the embodiments described above, but encompasses any and all embodiments within the scope of the following claims.

I claim:

1. A fire extinguishing ball, comprising:

an outer ball cage adapted to be rolled or tossed towards a source of fire;

an inner ball cage rotatably mounted inside the outer ball cage, the inner ball cage being freely rotatable about a first axis; and an internal fire extinguishing assembly rotatably mounted inside the inner ball cage, the internal fire extinguishing assembly being freely rotatable about a second axis different from the first axis, the internal fire extinguishing assembly having fire extinguishing agents under pressure and a heat-activated valve assembly, the valve assembly selectively introducing and dispersing fire extinguishing agents into and out of the internal fire extinguishing assembly;

wherein exposure to heat from the source of fire causes the valve assembly to open and disperse the fire extinguishing agents in a wide area and thereby extinguish the fire.

2. The fire extinguishing ball according to claim 1, wherein the outer ball cage comprises two vertically spaced ring connectors and a plurality of angularly spaced, curved wires attached to the ring connectors at their respective ends, the curved wires forming a ball shape.

3. The fire extinguishing ball according to claim 2, wherein each said ring connector comprises:

a body having a top side, a bottom side, and an outer side surface, the outer side surface having a plurality of mounting holes formed therein, the mounting holes being disposed at spaced intervals, each of the mounting holes being configured for receiving an end of one of said curved wires, the top side having a plurality of set holes formed therein, each of the set holes being in communication with a corresponding one of the mounting holes set screws disposed in the set holes and selectively bearing against the ends of said curved wires inside the corresponding mounting hole to secure said curved wires; and an inner bearing mounted in the body of said ring connector, the inner bearing facilitating free rotation of said inner ball cage when said inner ball cage is mounted inside said outer ball cage.

4. The fire extinguishing ball according to claim 1, wherein said inner ball cage comprises:

an upper mounting bracket;

a lower mounting bracket spaced away from the upper mounting bracket;

a plurality of curved wires connected to and extending between the upper and lower mounting brackets, the curved wires providing structure and shape to the inner ball cage;

a swivel joint assembly disposed on opposite sides of the inner ball cage, each of the swivel joint assemblies being slidably mounted to a pair of the curved wires, the swivel joint assembly facilitating free rotation of said internal fire extinguishing assembly about said second axis; and a mounting rod extending outward from each of the mounting brackets, each of the mounting rods mounting the respective mounting bracket to said outer ball cage.

5. The fire extinguishing ball according to claim 4, wherein said swivel joint assembly comprises:

a central swivel joint having a bearing, the bearing being for rotatably connecting said internal fire extinguishing assembly to the inner ball cage;

an extension bar connected to opposite sides of the central swivel joint; and a mounting head adjustably mounted to a distal end of each of the extension bars, the mounting head having a through bore slidably mounting the mounting head to one of said pair of curved wires.

6. The fire extinguishing ball according to claim 1, wherein said internal fire extinguishing assembly comprises:

a hollow, ball-shaped body, the body having an interior for holding compressed gas and fire extinguishing agents, the body having a central axis;

a connection rod attached to opposite ends of the body and defining the second axis, the connection rods being offset from the central axis, the connection rods being adapted for rotatably mounting the body to said inner ball cage about the second axis, the second axis being offset from the central axis, said valve assembly being disposed on top of the body;

wherein the offset second axis permits self righting of body with said valve assembly on top when the fire extinguishing ball is at rest.

7. The fire extinguishing ball according to claim 6, wherein said valve assembly comprises:

a valve housing attached to said body;

a first port and a second port extending from the valve housing, each of the ports being selectively used to fill said body with compressed air and fire extinguishing agents;

a flow tube connected to the valve housing, the flow tube having a first diameter and extending towards the bottom of said body, the flow tube permitting inflow and outflow of compressed air and fire extinguishing agents;

a dispersion tube attached to the valve housing, the dispersion tube having a diameter smaller than the diameter of the flow tube in order to increase exit pressure of the compressed air and fire extinguishing agents;

a support bracket stably supporting the dispersion tube; and a shroud attached to the support bracket, the shroud having an interior surface for deflecting the exiting compressed gas and fire extinguishing agents to thereby disperse the same in a wide circular area.

* * * * *